US008967423B2

(12) United States Patent
Sharpe et al.

(10) Patent No.: US 8,967,423 B2
(45) Date of Patent: Mar. 3, 2015

(54) DELIVERY VERIFICATION SYSTEM

(75) Inventors: Gary L. Sharpe, Naples, FL (US); Doug Clouser, Galloway, OH (US)

(73) Assignee: Gary L. Sharpe, Naples, FL (US)

( * ) Notice: Subject to any disclaimer, the term of this patent is extended or adjusted under 35 U.S.C. 154(b) by 614 days.

(21) Appl. No.: 12/960,969

(22) Filed: Dec. 6, 2010

(65) Prior Publication Data

US 2011/0132918 A1 Jun. 9, 2011

Related U.S. Application Data

(60) Provisional application No. 61/267,001, filed on Dec. 4, 2009.

(51) Int. Cl.
*A47G 29/14* (2006.01)
*A61J 1/16* (2006.01)

(52) U.S. Cl.
CPC .. *A47G 29/14* (2013.01); *A61J 1/16* (2013.01); *A61J 2205/40* (2013.01)
USPC ..... 220/737; 220/4.28; 220/23.86; 248/689; 248/318

(58) Field of Classification Search
CPC ..... A47G 29/14; A61J 1/16; A61J 2205/40
USPC ..... 220/4.31, 4.28, 23.83, 23.86, 737, 4.01; 248/689, 318; 206/736, 216, 600, 577
See application file for complete search history.

(56) References Cited

U.S. PATENT DOCUMENTS

| | | | | |
|---|---|---|---|---|
| 5,156,450 | A * | 10/1992 | Lee | 312/248 |
| 5,423,450 | A * | 6/1995 | Shillington et al. | 220/481 |
| 6,666,347 | B1 * | 12/2003 | Diamond | 220/4.03 |
| 7,600,638 | B2 * | 10/2009 | Finnestad et al. | 206/366 |
| 8,393,488 | B2 * | 3/2013 | Japuntich et al. | 220/254.1 |
| 2005/0103662 | A1 * | 5/2005 | Iske et al. | 206/366 |
| 2006/0231558 | A1 * | 10/2006 | Gayman | 220/476 |
| 2010/0133399 | A1 * | 6/2010 | Zaccolo et al. | 248/220.21 |
| 2013/0019526 | A1 * | 1/2013 | Lai | 47/81 |

* cited by examiner

*Primary Examiner* — Robert J Hicks
*Assistant Examiner* — Kareen Rush
(74) *Attorney, Agent, or Firm* — Standley Law Group LLP

(57) ABSTRACT

A system for providing correct delivery of pharmaceuticals or the like to a patient location has a mounting body, a matching plate, a storage box and elements for associating a particular matching plate, affixed to a surface of the mounting body, with a particular storage box. The mounting body should be adapted to be fixed in place at the patient location, thereby fixing in place a storage body engaged in it. The storage box has a unitarily-formed storage body, with an open face hingedly fitted with a door for closing the open face. Proper association of the matching plate with the particular occurs when the associating elements of the storage box and the matching plate register with each other, allowing an element of the mounting body to engage the storage box. Disengagement of the element can be effected only through access to the interior of the storage body.

19 Claims, 5 Drawing Sheets

DELIVERY VERIFICATION SYSTEM

CROSS-REFERENCE TO RELATED APPLICATIONS

This application is a non-provisional of U.S. 61/267,001, filed 4 Dec. 2010, to which a priority claim is made, and which is incorporated by reference as if fully recited herein.

TECHNICAL FIELD

The disclosed embodiments relate to a delivery verification system to insure correct medication is delivered to the proper location.

BACKGROUND OF THE ART

In many settings, especially any medical or pharmaceutical setting, it is important to insure the correct pharmaceuticals, medical devices or other objects are delivered to the proper location. Furthermore, it is important that proper controls be established and maintained for certain pharmaceuticals, medical devices or other objects. This may be complicated in situations where a particular pharmaceutical, medical device or other object may be used at various facilities and/or at different doses for different individuals.

Many times, different medications, such as pills and liquids may appear substantially similar to medical or pharmaceutical professionals. Moreover, those same substantially similar pills, liquids or other medications may easily be mistaken for one another by lesser trained professionals or laypersons who may end up administering or consuming the medications. Additionally, in many situations it is required that the medications, pharmaceuticals, medical devices or other objects are secured within a location that may be locked for security purposes. For example, a single prescription lens implant or some pace makers may be worth thousands of dollars. Additionally, many times small orthopedic parts are expensive and because of very small differences between screws and other hardware, it is very important to get the right parts to the right surgeon, patient or operating room.

It is therefore an unmet advantage of the prior art to provide a medication delivery verification system wherein a locking container or box may only be secured within a corresponding mounting body positioned on the wall where the geometry of the storage box matches the geometry of mounting body for securement of the storage box to occur. The system helps insure that the correct medication is delivered to the proper location. It is also an unmet advantage of the prior art to provide a locking storage container that can only be removed from the mounting body if the storage box is unlocked and a retaining device is depressed.

SUMMARY OF THE INVENTION

This and other unmet advantages are provided by a system for assuring correct delivery of pharmaceuticals or the like to a patient location. Such as system comprises a mounting body, adapted to be fixed in place at the patient location; a matching plate, a first surface of the matching plate affixed to a surface of the mounting body; a storage box, comprising a unitarily-formed storage body, having an open face hingedly fitted with a door for closing the open face; and means for associating the matching plate with a particular storage box, the associating means disposed on a second face of the matching plate which opposes the first face and on a selected face of the storage box.

In some embodiments, the associating means will comprise at least two sets of aperture and protrusion elements, one of the elements of each set disposed on the matching plate and the other element of the set disposed on the selected storage box face, each respective set of elements registering upon placement of the storage box onto the mounting body. In such an embodiment, there will also be means for aligning registration of the associating means, disposed on the storage box and the mounting body, which may comprise at least one flange and a corresponding channel for receiving the flange, the flange disposed on the storage box and the channel disposed on the mounting body.

In some embodiments, the system will further comprise a plate, affixed to a face of the storage box and extending beyond the edges thereof to define the at least one flange.

In some embodiments, the storage box will be molded from a thermoplastic, and especially, a thermoplastic selected to be sterilizable by gamma radiation and resistant to dilute acids, bases and soaps for cleaning purposes, such as the thermoplastic is glycol-modified polyethylene-terephthalate.

In the embodiments, at least one face of the storage body has an aperture therein.

In the embodiments, there is a means for securing access to an interior of the storage box, disposed on the door and the storage body.

In the system, there is also means for selectively engaging the storage box in the mounting body when the associating means are in registration, such that access to the interior of the storage box is necessary for disengaging the storage box from the mounting body. In one such embodiment, this means for selectively engaging comprises a spring clip mounted on the mounting body and an aperture for receiving the spring clip on the storage box.

BRIEF DESCRIPTION OF THE DRAWINGS

A better understanding of the disclosed embodiments will be obtained from a reading of the following detailed description and the accompanying drawings wherein identical reference characters refer to identical parts and in which.

DETAILED DESCRIPTION OF A PREFERRED EMBODIMENT

Figure 1:
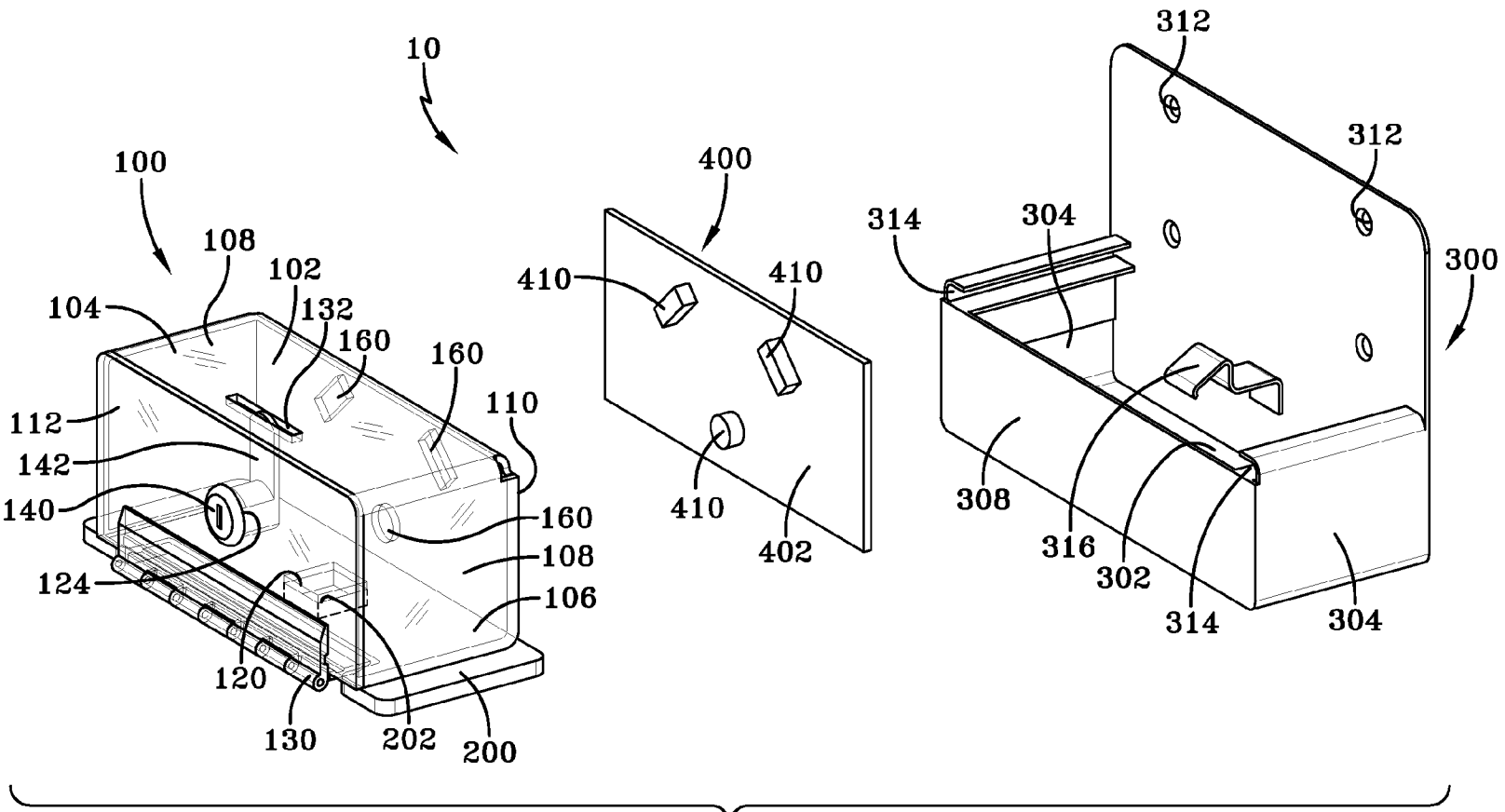
FIG. 1 is an exploded perspective view of an embodiment of a medication delivery verification system.
Figure 2:
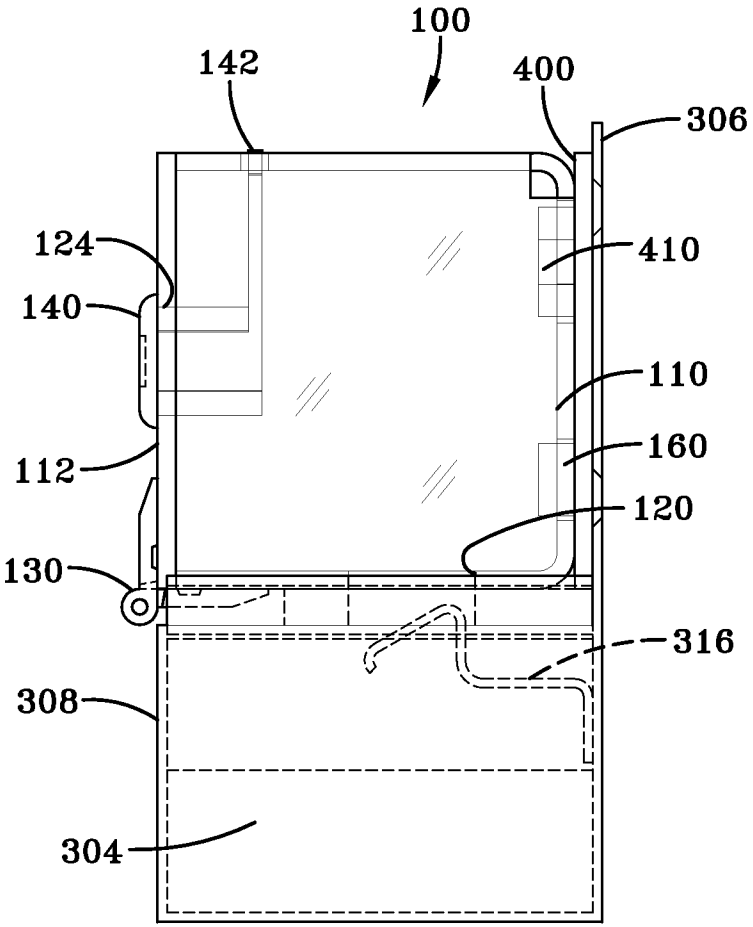
FIG. 2 is an assembled left side elevation view of the FIG. 1 system, wherein the storage box and matching plate are in association with the mounting body.
Figure 3:
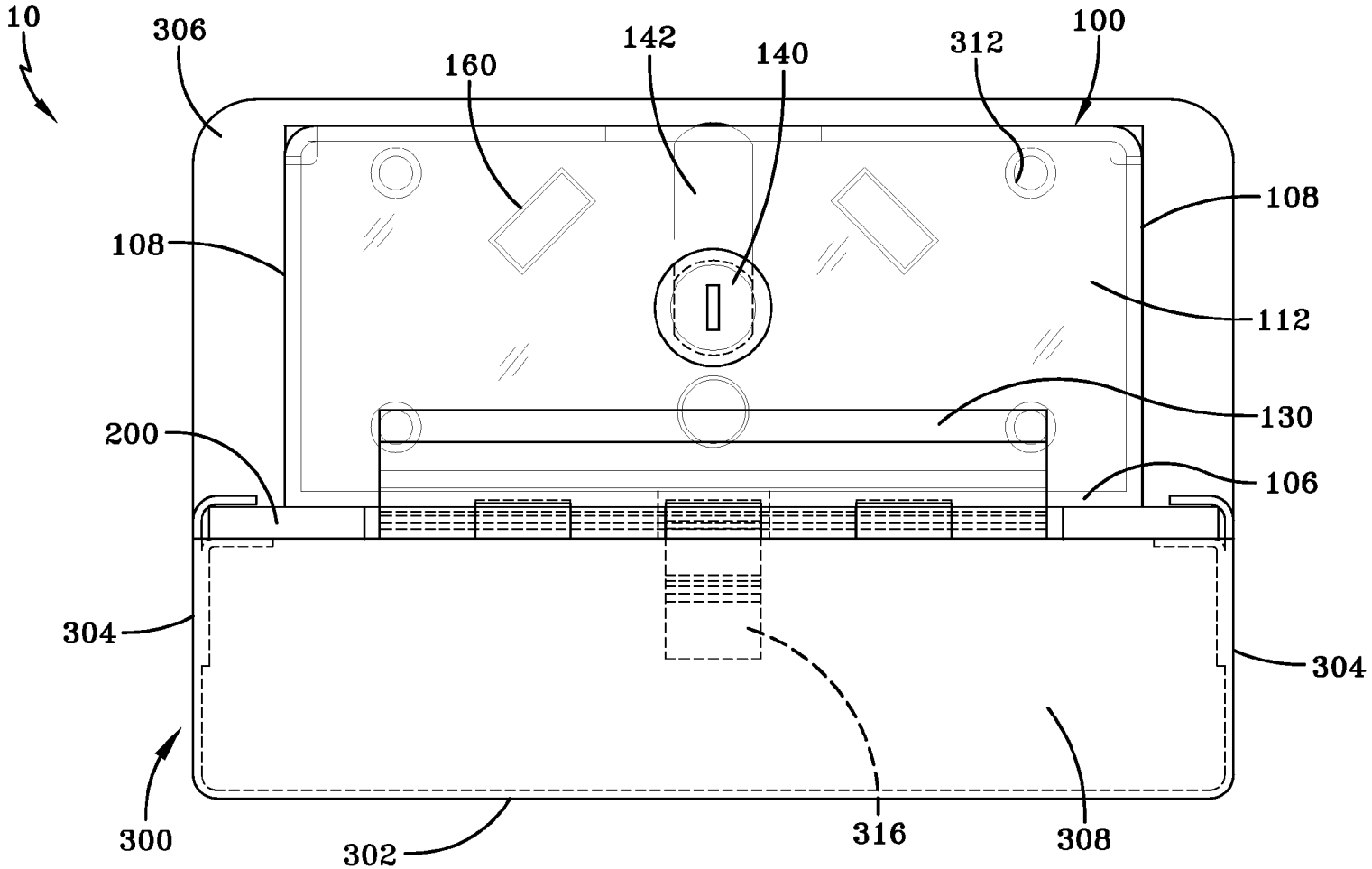
FIG. 3 is an assembled front elevation view of the FIG. 1 system, wherein the storage box and matching plate are in association with the mounting body.

FIG. 1 shows an embodiment of a delivery verification system 10 in a break-out perspective view, with FIGS. 2 and 3 showing other views of the system wherein the components are fully associated during use. Exemplary embodiments of the system 10 include a storage box 100 generally including a body 102, which is preferably formed in a unitary manner to provide top and bottom walls 104, 106, side walls 108, and a rear wall 110. The front face of the body 102 is open and a front door 112 is used to provide closure to the front face.

In exemplary embodiments, the storage box 100 may be molded from a transparent thermoplastic, especially a glycol-modified polyethylene terephthalate ("PETG") co-polyester. The PETG material, in an amorphous state, has an appropriate stiffness, hardness and toughness for the required service and also provides good impact strength. The transparent nature of the material is very useful is rendering the contents of the storage box 100 readily recognizable even while the box is locked. The PETG can be sterilized with gamma radiation and is generally resistant to dilute aqueous solutions of mineral acids, bases, salts and soaps, so it may be readily cleansed as needed. It has good resistance to aliphatic hydrocarbons, alcohols and a variety of oils. In other exemplary embodiments, the storage box may be molded from other materials, such as but not exclusively: acrylics, plastics, fiberglass, metals, etc. In some embodiments, the material used to fabricate the storage box may be substantially transparent so that an individual may inspect the contents of the box without unlocking the box. However, in some embodiments in high-security environments, the storage box 100 may be fabricated from an opaque material to reduce the likelihood of theft, such as in the case of the box used for containing scheduled substances, such as, for illustrative purposes only, OXYCONTIN (a registered trademark of Purdue Pharma LP), morphine, propofol or other drugs. Furthermore, storage boxes may be color-coded for different reasons.

In some exemplary embodiments, the body 102 may be provided with at least one aperture 120 through the bottom wall 110. Similar apertures could be provided on either or both of the side walls 108, and/or the rear wall 110. The primary function of the aperture is to allow attachment, although a secondary function that is provided is to allow limited circulation of the air into the interior of the storage box 100, thereby equilibrating the temperatures of the interior and exterior of the box.

Certain features of the door 112 are readily observed in the figures. The door 112 is depicted as having being connected by at least one hinge 130 to the bottom section of the front face of the body 102. In the embodiment illustrated, the hinges are arranged with the gudgeons and pintles of the hinges positioned outside of the storage box 100. In an alternate embodiment, the hinges could be placed so that the pintles and gudgeons are inside the storage box, making unauthorized entry into the storage box 100 more difficult. Door 112 is provided with an opening 124 for receiving a lock. In the embodiment depicted there, the lock 140 is a key lock with an arm 142 that may be rotated into engagement with a slot 132 in the front portion of the top wall 104. To frustrate access to the box interior by forcing the arm 142 through a gap at the top of the front opening, the front edge of the top wall may be provided with a rabbet joint. In some embodiments, the storage box 100 would be provided without the locking means, as the user can provide the lock. While a rotating key lock is illustrated, other locking means, such as a combination lock, pushbutton lock or electronic lock, are also useful in this application. It is also possible to use multiple locks on one locking storage box. This could be accomplished by using two key, combination, pushbutton or electronic locks or any mixture of these or other lock types.

Exemplary embodiments of the system include at least one receiving plate 200. In this embodiment, preferably, at least a portion of the receiving plate 200 protrudes beyond the exterior face of the side wall 108 of the body 102 to allow attachment to the mounting body 300. Although a receiving plate 200 may be unitarily formed with the bottom wall 106 of the body 102, in this example the receiving plate 200 is associated with the bottom wall 106 of the body through an adhesive means. However, in other exemplary embodiments, any other means of securement may be used, such as, for example, fasteners, welding, fusion, etc. Depending upon the design of the mounting body 300, more than one receiving plate 200 may be associated with the body 102. In some exemplary embodiments, the receiving plate 200 may be provided with at least one aperture 202. The primary function of the aperture 202 is to allow attachment, although a secondary function that is provided is to allow limited circulation of the air into the interior of the storage box 100 if the aperture 202 corresponds with an aperture 120 located on the body 102, thereby equilibrating the temperatures of the interior and exterior of the box.

At least one matching depression 160 is located on the rear wall 110 of the body 102. The matching depressions 160 may be a number of different geometries and sizes. As shown in this embodiment, three matching depressions 160 are located on the rear wall in a first arrangement. In other embodiments, matching apertures (not shown) may be used in addition to or as a substitute for the matching depressions. The matching depressions 160 may be configured in a number of different arrangements located on the rear wall 110 of the body, with varying geometries of each depression and varying numbers of depressions. The different arrangements may correspond to the use of different boxes, patients, drugs located within the boxes, etc. For example, in a first arrangement the matching depressions 160 may correspond to medicines to be delivered to a first room for a first patient, a second arrangement may correspond to medicines to be delivered to the first room for a second patient, and a third arrangement may correspond to medicines to be delivered to a second room for a third patient, etc. The different arrangements help assure that the correct medications are supplied to the right locations and to diminish the chances that the patients receive the wrong medications.

Exemplary embodiments of the system 10 include a mounting body 300, which is preferably formed in a unitary manner to provide a bottom wall 302, side walls 304, a rear wall 306, and a front wall 308. In other exemplary embodiments, the walls of the mounting body may be formed independently and secured together by a securing means. In this embodiment, at least a portion of the rear wall 306 of the mounting body 300 protrudes to a height above the side walls 304 to allow the association of the matching plate 400 thereto. Additionally, at least one fastening aperture 312 may be provided for the securement of the mounting body 300 to a wall or other surface (not shown). Preferably, to increase the security of system 10, the at least one fastening aperture 312 is located on the rear wall 306 at a position behind the matching plate 400 and/or storage box 100 when the components of the system are associated. The mounting body includes at least one receiving channel 314 for receiving the receiving plate 200 when the storage box 100 slidably engages the mounting body 300. At least one spring clip 316 or similar device is associated with the rear wall 306 of the mounting body 300 and positioned so that when the storage box 100 is properly installed within the mounting body 300, the spring clip 316 engages the aperture 202 on the receiving plate 200, securing the storage box 100 within the mounting body 300. The storage box 100 may only be removed from the wall only after the front door 112 has been unlocked and the spring clip 316 or similar retaining device has been depressed.

In some exemplary embodiments, the body 102 may be provided with at least one aperture 120 through the bottom wall 106. Similar apertures could be provided on either or both of the side walls 108, and/or the rear wall 110. The primary function of the aperture is to allow attachment, although a secondary function that is provided is to allow limited circulation of the air into the interior of the storage box 100, thereby equilibrating the temperatures of the interior and exterior of the box.

Exemplary embodiments of the system 10 may include at least one matching plate 400. In this example, a single matching plate is substantially flat and rectangular with at least one matching protrusion 410 located on the front surface of 402. The matching protrusions 410 may be a number of different geometries and sizes. As shown in this embodiment, three matching protrusions 410 are located on the front surface in a first arrangement. The matching protrusions 410 may be configured in a number of different arrangements located on the front surface 402 of the matching plate 400, with varying geometries of each protrusion and varying numbers of protrusions. The different arrangements may correspond to the use of different boxes, patients, drugs located within the boxes, etc. For example, in a first arrangement the matching protrusions 410 may correspond to medicines to be delivered to a first room for a first patient, a second arrangement may correspond to medicines to be delivered to the first room for a second patient, and a third arrangement may correspond to medicines to be delivered to a second room for a third patient, etc. The different arrangements help assure that the correct medications are supplied to the right locations and to diminish the chances that the patients receive the wrong medications.

The matching plate 400 may be associated with the mounting body 300 by any number of association means, including but not limited to: adhesives, fasteners, welding, etc. The matching plate 400 may be fabricated from different materials, preferably able to withstand tampering by individuals, including, but not limited to: metals, plastics, fiberglass, etc. Other different types of devices for acknowledging the correct storage box is in association with the correct mounting body may be used in addition to the matching bodies. In one example, proximity sensors contained on the storage box and mounting bodies may signal with lights contained on the mounting body whether or not the correct storage box is located with the mounting body.

As aforementioned, during use, exemplary embodiments of the system utilize different matching bodies located on mounting bodies to control whether or not a locking storage box will fit within the mounting body. The system is intended to help insure the correct medication is delivered to the proper location, in a hospital or other health setting. In one example, multiple mounting bodies are installed in various rooms within a hospital and multiple storage boxes are filled with varying medications at another location. When delivering the storage box 100, it will only fully slidably engage and secure within the receiving channels 314 of the mounting body 300 if the depressions on the rear face of the storage box match the protrusions located on the corresponding matching plate. When the storage box 100 is properly installed within the mounting body 300, the spring clip 316 engages the aperture 202 on the receiving plate 200, securing the storage box 100 within the mounting body 300. The storage box 100 may only be removed from the wall only after the front door 112 has been unlocked and the spring clip 316 or similar retaining device has been depressed.

Figure 4:
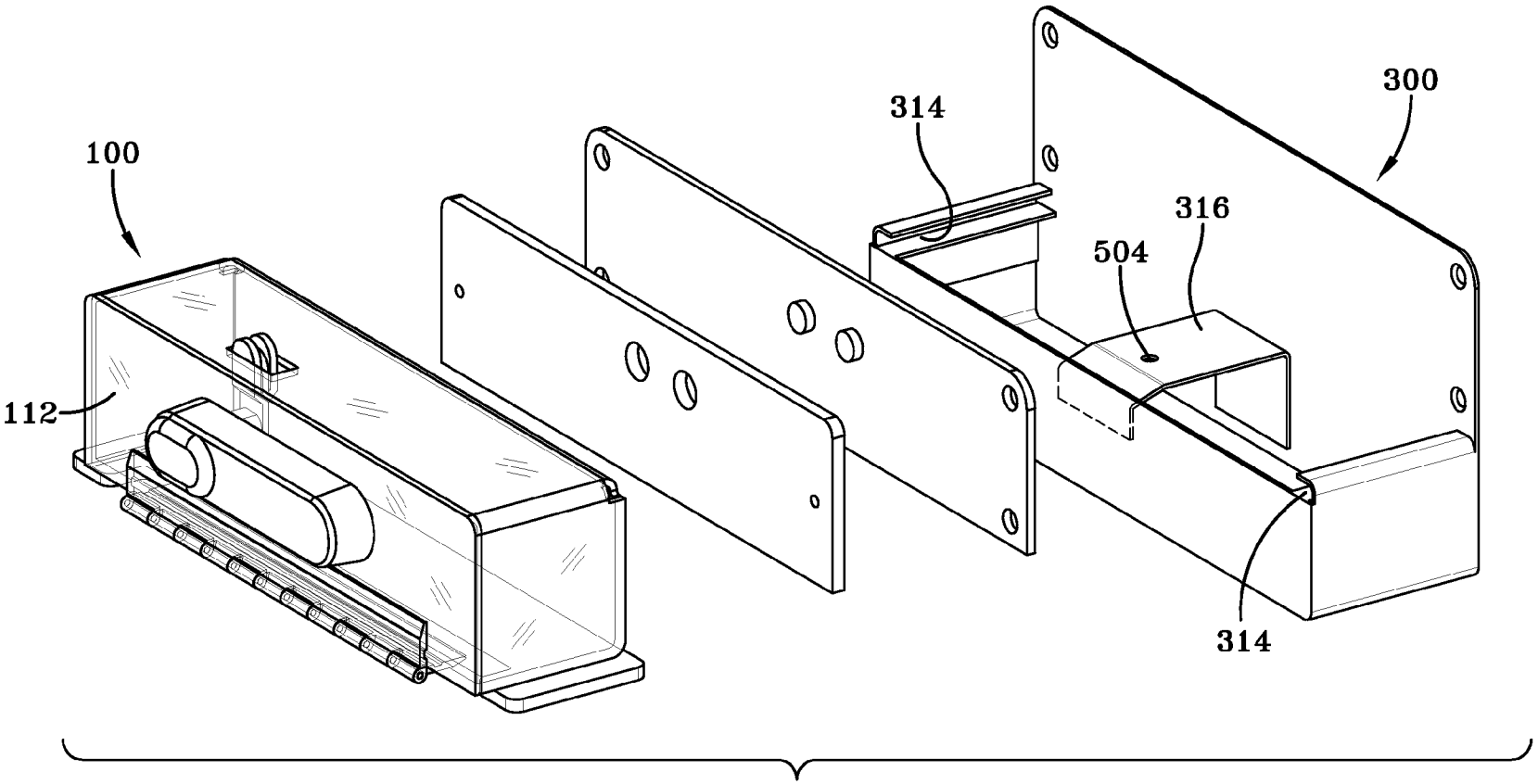
FIG. 4 is an exploded perspective view of a second embodiment of a medication delivery verification system.
Figure 5:
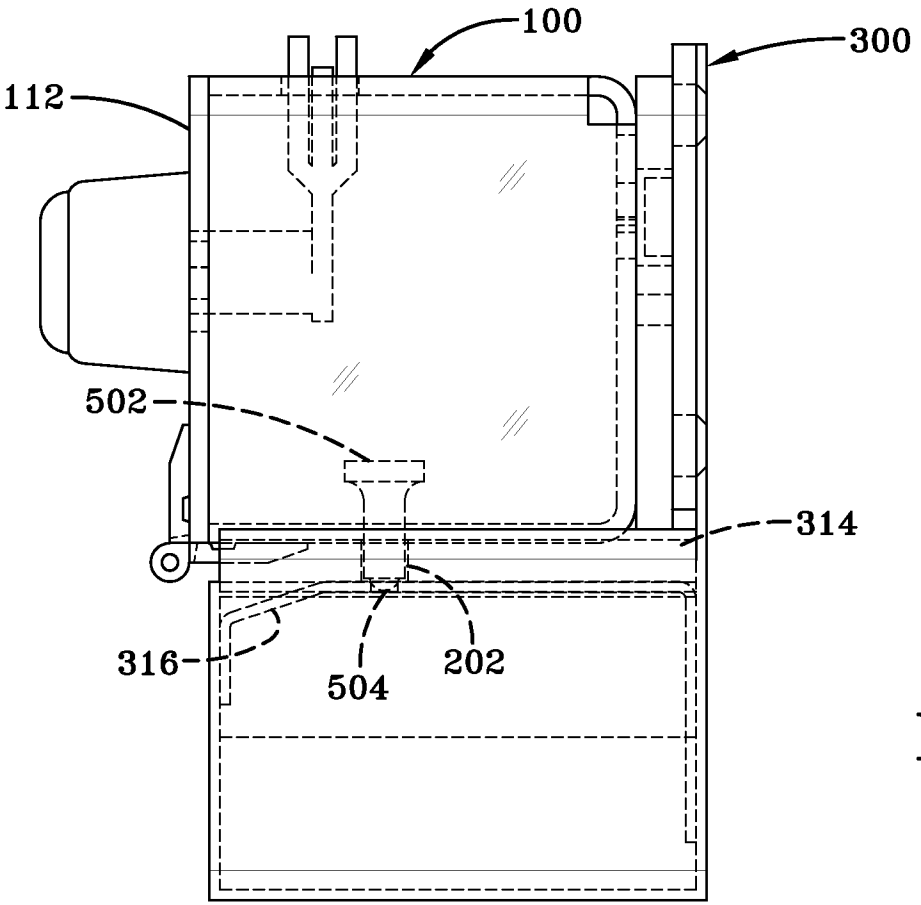
FIG. 5 is an assembled side elevation view of the FIG. 4 embodiment.

FIGS. 4 and 5 provide two views of an alternate embodiment, in which many of the parts are the same as in FIGS. 1-3. As in FIGS. 1-3, the storage box 100 in this alternate embodiment will fully slidably engage and secure within the receiving channels 314 of the mounting body 300 only if the associating means on the matching plate and the storage box properly register with each other. When that occurs, a plunger 502, preferably spring-loaded or otherwise downwardly biased, will extend downwardly through the aperture 202 and an end of the plunger will engage an aperture 504 in bracket 316, securing the storage box 100 within the mounting body 300. The storage box 100 may only be removed from the wall only after the front door 112 has been unlocked and the plunger 502 or similar retaining device has been disengaged.

What is claimed is:

1. A system for assuring correct delivery of pharmaceuticals to a patient location, comprising:

a mounting body adapted to be fixed in place at the patient location;

a storage box comprising a unitarily-formed storage body with an open face hingedly fitted with a door for closing the open face;

means for aligning the storage box into registration with the mounting body, a first part of the registration aligning means on the mounting body and a second part of the registration aligning means on the storage box; and means for associating the mounting body uniquely with the storage box, the associating means comprising at least two sets of aperture and protrusion elements, one of the elements of each set associated with the mounting body and the other element of the set associated with the storage box face, the aperture and protrusion elements registering upon engaging the respective registration aligning means.

2. The system of claim 1, wherein:

the registration aligning means comprises at least one flange and a corresponding channel for receiving the flange, the flange disposed on the storage box and the channel disposed on the mounting body.

3. The system of claim 2, further comprising:

means for selectively engaging the storage box in the mounting body when the associating means are in registration, such that access to the interior of the storage box is necessary for disengaging the storage box from the mounting body.

4. The system of claim 3, wherein:

the means for selectively engaging comprises a spring clip mounted on the mounting body and an aperture for receiving the spring clip on the storage box.

5. The system of claim 2, further comprising:

a plate, affixed to a face of the storage box and extending beyond the edges thereof to define the at least one flange.

6. The system of claim 1, wherein:

the storage box is molded from a thermoplastic.

7. The system of claim 6, wherein:

the thermoplastic is selected to be sterilizable by gamma radiation and resistant to dilute acids, bases and soaps for cleaning purposes.

8. The system of claim 7, wherein:

the thermoplastic is glycol-modified polyethylene-terephthalate.

9. The system of claim 1, wherein:

at least one face of the storage body has an aperture therein.

10. The system of claim 1, further comprising:

means for securing access to an interior of the storage box, disposed on the door and the storage body.

11. The system of claim 1, wherein:

the set of associating means elements associated with the mounting body are formed on a matching plate that is affixed to a surface of the mounting body.

12. The system of claim 11, wherein:

the set of associating means elements associated with the storage box is formed on a plate affixed to a face of the storage body.

13. The system of claim 11, wherein:

the set of associating means elements associated with the storage box is formed on a face of the storage body.

14. The system of claim 1, wherein:

the set of associating means elements associated with the mounting body is formed on a surface of the mounting body.

15. The system of claim 14, wherein:

the set of associating means elements associated with the storage box are formed on a face of the storage body.

16. The system of claim 1, further comprising:

means for selectively engaging the storage box in the mounting body when the associating means are in registration, such that access to the interior of the storage box is necessary for disengaging the storage box from the mounting body.

17. The system of claim 16, wherein:

the means for selectively engaging comprises a spring clip mounted on the mounting body and an aperture for receiving the spring clip on the storage box.

18. The system of claim 14, wherein:

the set of associating means elements associated with the storage box are formed on a plate affixed to a face of the storage body.

19. A system for assuring correct delivery of pharmaceuticals to a patient location, comprising:

a mounting body adapted to be fixed in place at the patient location;

a storage box comprising a unitarily-formed storage body with an open face hingedly fitted with a door for closing the open face;

means for aligning the storage box into registration with the mounting body, a first part of the registration aligning means on the mounting body and a second part of the registration aligning means on the storage box; and means for associating the mounting body uniquely with the storage box, the associating means comprising at least one set of aperture and protrusion elements, one of the elements of the at least one set associated with the mounting body and the other element of the at least one set associated with the storage box face, the aperture and protrusion elements of the at least one set registering upon engaging the respective registration aligning means.

* * * * *